US007056222B2

(12) United States Patent
Skelley

(10) Patent No.: US 7,056,222 B2
(45) Date of Patent: Jun. 6, 2006

(54) GOLF SWING TRAINING DEVICE

(76) Inventor: William Skelley, 248 Dominica Cir., Niceville, FL (US) 32578

( * ) Notice: Subject to any disclaimer, the term of this patent is extended or adjusted under 35 U.S.C. 154(b) by 0 days.

(21) Appl. No.: 10/653,314

(22) Filed: Sep. 2, 2003

(65) Prior Publication Data

US 2005/0049061 A1 Mar. 3, 2005

(51) Int. Cl.
*A63B 69/36* (2006.01)

(52) U.S. Cl. ..... 473/219; 473/226; 473/257

(58) Field of Classification Search ..... 473/219, 473/226, 227, 267, 268, 257–276
See application file for complete search history.

(56) References Cited

U.S. PATENT DOCUMENTS

| | | | | | |
|---|---|---|---|---|---|
| 1,990,281 | A | | 2/1935 | Grelle | |
| 3,462,155 | A | * | 8/1969 | Pelz | 473/238 |
| 3,874,668 | A | * | 4/1975 | Flege | 473/227 |
| 4,023,812 | A | | 5/1977 | Lorang | |
| 4,053,160 | A | | 10/1977 | Salata | |
| 5,009,426 | A | * | 4/1991 | Cox | 473/227 |
| D317,491 | S | * | 6/1991 | Rhodes | D21/735 |
| 5,071,129 | A | * | 12/1991 | Wilson | 473/240 |
| 5,121,925 | A | | 6/1992 | Blundo | |
| 5,127,650 | A | * | 7/1992 | Schneller | 473/204 |
| 5,167,415 | A | | 12/1992 | Iandola | |
| 5,209,481 | A | | 5/1993 | DeBack | |
| 5,294,126 | A | | 3/1994 | Armstrong | |
| 5,328,185 | A | * | 7/1994 | Finnigan et al. | 473/294 |
| D356,135 | S | | 3/1995 | Slusher | |
| 5,458,340 | A | | 10/1995 | Jackson | |
| 5,976,024 | A | * | 11/1999 | Marshall, Jr. | 473/227 |
| 5,997,408 | A | | 12/1999 | Bankhead | |
| 6,004,221 | A | * | 12/1999 | Thornhill | 473/227 |
| 6,071,197 | A | * | 6/2000 | Curtis | 473/240 |
| 6,251,025 | B1 | * | 6/2001 | Brock et al. | 473/227 |
| 6,283,874 | B1 | | 9/2001 | Studebaker | |
| 6,416,419 | B1 | | 7/2002 | Foresi | |
| D463,657 | S | * | 10/2002 | Wilkinson | D3/7 |
| 6,533,676 | B1 | * | 3/2003 | D'Angelo et al. | 473/239 |
| 6,800,036 | B1 | * | 10/2004 | Rohan-Weaver | 473/219 |
| 6,881,155 | B1 | * | 4/2005 | Rohan-Weaver | 473/219 |
| 2002/0094879 | A1 | | 7/2002 | Dawson | |

OTHER PUBLICATIONS

Photographs (2) of the "Rohan-Weaver" Device.

* cited by examiner

*Primary Examiner*—Nini F. Legesse
(74) *Attorney, Agent, or Firm*—Laurence P. Colton; Powell Goldstein LLP

(57) ABSTRACT

A device and method for practicing a golf swing using a device to simulate golf club and having one or more a positioning components such as a forearm guide, a golf ball sighting mirror and/or a vertical indicator.

44 Claims, 10 Drawing Sheets

GOLF SWING TRAINING DEVICE

BACKGROUND OF THE INVENTION

1. Technical Field.

The invention is directed generally to the field of golf accessories and is directed more specifically to the field of golf swing training devices.

2. Prior Art.

The field of golf accessories is a large and growing field. One category within the field of golf accessories is the category of swing training devices. Quite simply, many, if not most, golfers have a desire to improve their golf swing, thus improving their golf game. Many different swing training devices have been developed and are available to help golfers improve their golf swings.

A first known device is the "Rohan-Weaver" device, which discloses a length of bent tubing and a golf grip. The Rohan-Weaver device comprises a first portion of tubing to show when the golfer is in the correct position to address the golf ball, a second portion of tubing to show when the golfer is in the correct position at the top of the backswing, and an end portion to show when the golfer is in the correct position at the end of the swing.

A second known device is shown in U.S. Patent Publication No. 20020094879 to Dawson, which also discloses a length of bent tubing and a golf grip. The Dawson device comprises a "J" shape, the end of which touches the center of the golfer's back at the top of the backswing to show when the golfer is in the correct position at the top of the backswing.

Other known devices are shown in U.S. patents. U.S. Pat. No. 6,416,419 to Foresi discloses a golf swing aid comprising a bent member that extends over the hands of the golfer. U.S. Pat. No. 6,283,874 to Studebaker discloses a golf putter having a curved portion that fits under the golfer's underarm. U.S. Pat. No. 5,997,408 to Bankhead discloses a golf training aid for chipping and putting.

U.S. Pat. No. 5,458,340 to Jackson discloses a golf swing training device having a sling attached to the device and extending to and attached to a wall. U.S. Pat. No. 5,294,126 to Armstrong discloses a golf swing aid comprising a dual-purpose purpose aid. U.S. Pat. No. 5,209,481 to DeBack discloses a golf swing aid that is essentially a weight for swinging and building up the muscles. U.S. Pat. No. 5,167,415 to landola discloses a golf swing training club that is an elongated shaft having a simulated golf ball on either end. U.S. Pat. No. 5,121,925 to Blundo discloses a golf swing training club that comprises weights.

U.S. Pat. No. 4,053,160 to Salata discloses a golf club swing training device comprising an alignment member (a mirror) through which the golfer can see the hole. U.S. Pat. No. 4,023,812 to Lorang discloses a golf swing wrist action training device that comprises a leg that touches the golfer's hand or wrist and causes a click during a simulated golf swing to indicate to the golfer that he has fully cocked his wrists. U.S. Pat. No. 1,990,281 to Grelle discloses a practice golf club that has a detachable portion. U.S. Design Pat. No. 356,135 discloses an ornamental design for a golf swing training aid.

Although the prior art can assist the golfer in certain aspects of the golf swing, the present inventor is unaware of a single, portable, lightweight, compact device that can assist the golfer in substantially all aspects of the golf swing. Accordingly, there is a need for a golf swing training device that can be used to assist the golfer in determining whether the golfer is in the correct position throughout the golf swing. There also is a need for a golf swing training device that is portable, light weight and compact. It is to these needs and other needs that the present invention is directed.

BRIEF SUMMARY OF THE INVENTION

The present invention is a golf sing training device having a unique shape and unique components that allow the user to set up a proper swing motion. The basic elements of the invention comprise a grip, a down shaft, a cross shaft, an up shaft, a sighting and angling section, and a positioning section. The basic elements preferably are securely attached to each other in this order, and may be formed of a unitary superstructure or tubing, or may be separated structures welded, screwed, bolted, pinned or otherwise secured to each other. The invention preferably has a weight and swing feel similar to a conventional golf club, and may be manufactured at different weights to simulate different types of clubs, namely, wedges, irons and drivers. Alternatively, separate weights may be attached to the invention for this purpose.

The primary purpose of the invention is to train a user in the proper golf swing technique. In use, the invention is used to simulate the golf swing. The various golf swing training components give the user a tactile indication if and when the user is holding the invention, and thus a golf club, in the proper position throughout the typical golf swing. More specifically, during different aspects of the golf swing, the user can use the various golf swing training components to determine if the user is holding the invention, and therefore by comparison if the user is holding a golf club, in the proper position. The invention allows the user to determine whether the user's hands and arms are properly positioned for a golf swing. Repetitive use of the invention trains the user in the proper positioning of the golf club during the golf swing.

For these purposes, the invention comprises one or more golf swing training components, such as a sighting mirror for viewing the golf ball when the user is holding the invention in the proper position at the top of the backswing, a vertical indicator for indicating to the user that the invention is in the proper position at the top of the backswing, a forearm guide for indicating to the user when the invention is in the proper position both at the top of the backswing and at the end of the complete golf swing, a sighting window for viewing the golf ball when the user is holding the invention in the proper position at the golf ball address position, and/or a ball address positioning section for indicating to the user that the invention in the proper position at the golf ball address position.

The grip can be any type of golf grip, but preferably is a teaching grip that will assist the user in maintaining a proper grip on a golf club. Typically such grips are removable and interchangeable so that the user can substitute different grips on the invention as the user sees fit.

The sighting mirror is for viewing the golf ball when the user is holding the invention in the proper position at the top of the backswing. The sighting mirror is mounted on the sighting and aligning section of the superstructure in such a position that when the user has the invention at the top of the backswing, thus simulating a golf club at the top of the backswing, the user can view in the sighting mirror a golf ball sitting on a tee in the proper position on the ground. When the user can see the golf ball in the sighting mirror in this position, the user is holding the invention in the proper position, thus simulating holding a golf club in the proper position, at the top of the backswing.

The vertical indicator is for indicating to the user that the invention is in the proper position at the top of the backswing. The vertical indicator is mounted on the sighting and aligning section of the superstructure in such a position that when the user has the invention at the top of the backswing, thus simulating a golf club at the top of the backswing, the vertical indicator points vertically down to the ground. When the vertical indicator is pointing vertically down to the ground in this position, the user is holding the invention in the proper position, thus simulating holding a golf club in the proper position, at the top of the backswing. There can be three vertical indicators for use with wedges, irons and woods due to the different relative lengths of these three types of clubs.

The forearm guide is for indicating to the user when the invention is in the proper position both at the top of the backswing and at the end of the complete golf swing. The forearm guide is mounted on the sighting and aligning section of the superstructure in such a position that when the user has the invention at the top of the backswing, thus simulating a golf club at the top of the backswing, the forearm guide touches the user's right forearm (for right handed golfers). When the forearm guide touches the user's forearm in this position, the user is holding the invention in the proper position, thus simulating holding a golf club in the proper position, at the top of the backswing. Further, when the user has the invention at the end of the golf swing, thus simulating a golf club at the end of the golf swing, the forearm guide touches the user's left forearm (for right handed golfers). When the forearm guide touches the user's forearm in this position, the user has followed through with the golf swing properly, thus simulating a proper golf swing follow through. For left handed golfers, the forearm guide touches the user's left forearm at the top of the backswing and the user's right forearm at the end of the follow through.

The sighting window is for viewing the golf ball when the user is holding the invention in the proper position at the golf ball address position. When the user has the invention in the golf ball address position, thus simulating a golf club at the golf ball address position, the user can view through the sighting window a golf ball sitting on a tee in the proper position on the ground. When the user can see the golf ball in the sighting window in this position, the user is holding the invention in the proper position, thus simulating holding a golf club in the proper position, at the ball address position.

The ball address positioning section is for indicating to the user that the invention is in the proper position at the golf ball address position. When the user has the invention at the ball address position, thus simulating a golf club at the ball address position, the ball address positioning section points directly towards the center of the user's chest. When the ball address positioning section points directly towards the center of the user's chest, the user is holding the invention in the proper position, thus simulating holding a golf club in the proper position, at the ball address position.

The features and advantages of the present invention will become even more apparent to those of ordinary skill in the art when the following detailed description of the preferred embodiments is read in conjunction with the appended figures in which like reference numerals designate like parts throughout the several views.

DETAILED DESCRIPTION OF THE PREFERRED EMBODIMENTS

Figure 6A:
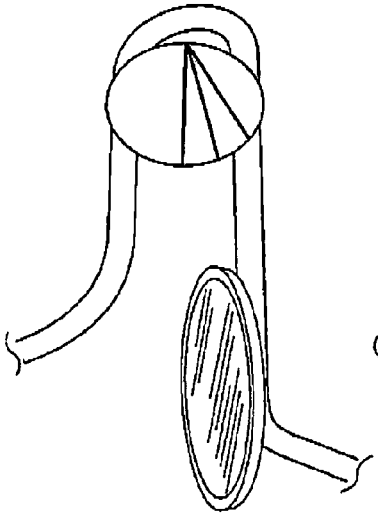
FIG. 6 are enlarged views of the vertical indicator on the invention at the top of the backswing, with FIG. 6A showing the positioning of the invention when simulating a wedge, FIG. 6B showing the positioning of the invention when simulating an iron, and FIG. 6C showing the positioning of the invention when simulating a wood.
Figure 6B:
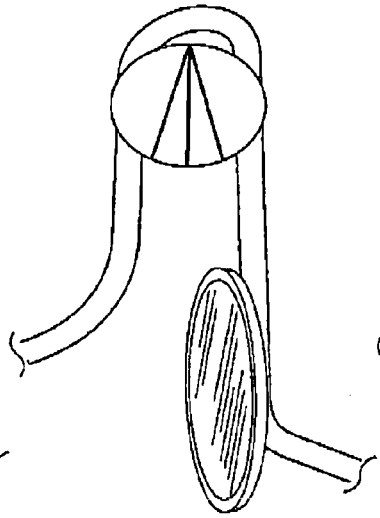
Figure 6C:
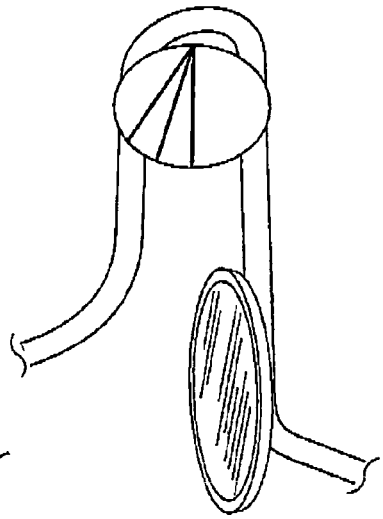
Figure 7:
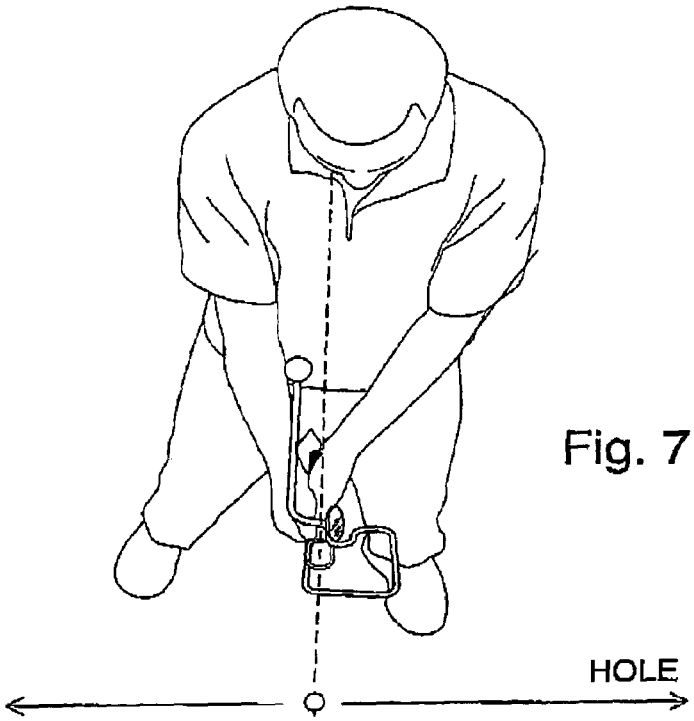
FIG. 7 is a schematic overhead view of a golfer addressing a golf ball.
Figure 8:
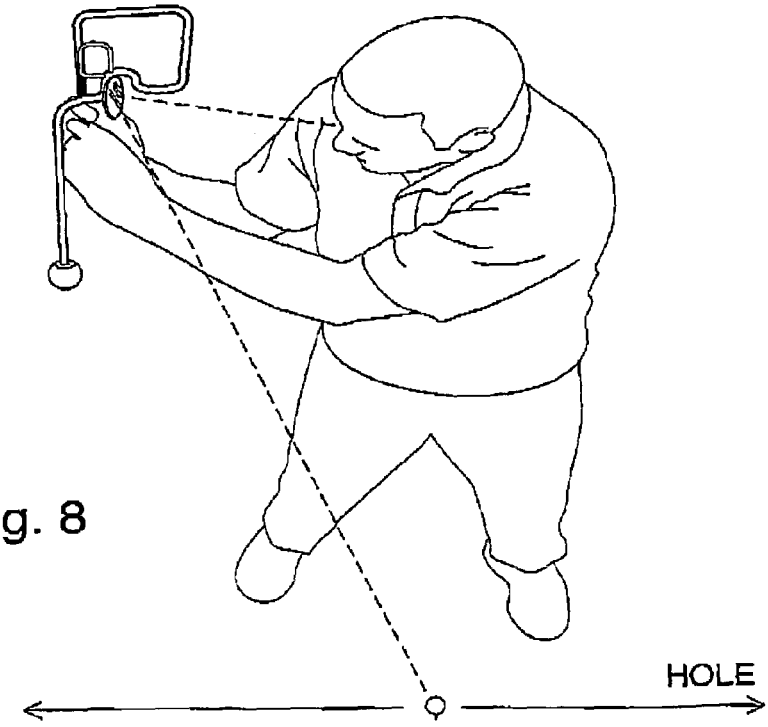
FIG. 8 is a schematic overhead view of a golfer at the top of the backswing.
Figure 16:
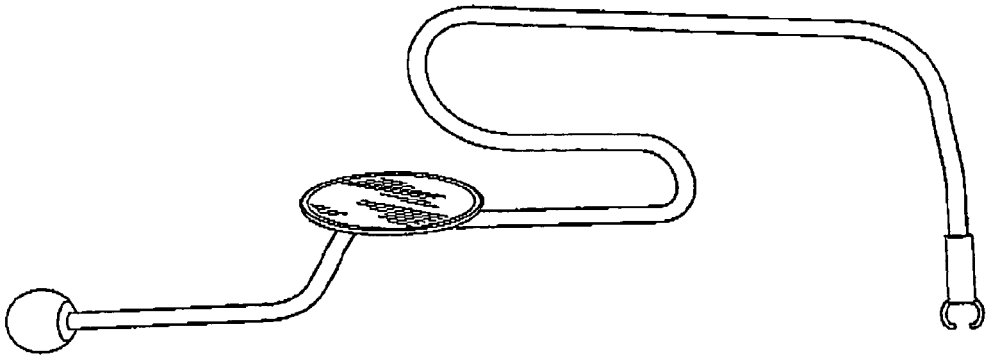
FIG. 16 is a front view of a third embodiment of the present invention.
Figure 17:
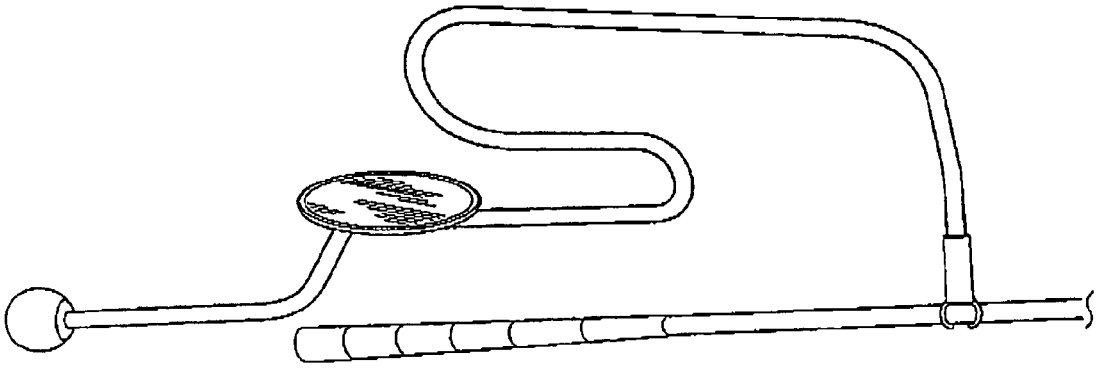
FIG. 17 is a front view of the third embodiment of the present invention shown in FIG. 16 attached to a golf club.
Figure 18:
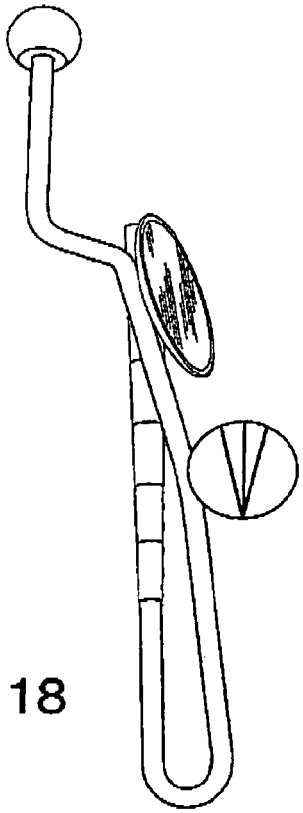
FIG. 18 is a front view of a fourth embodiment of the present invention.
Figure 19:
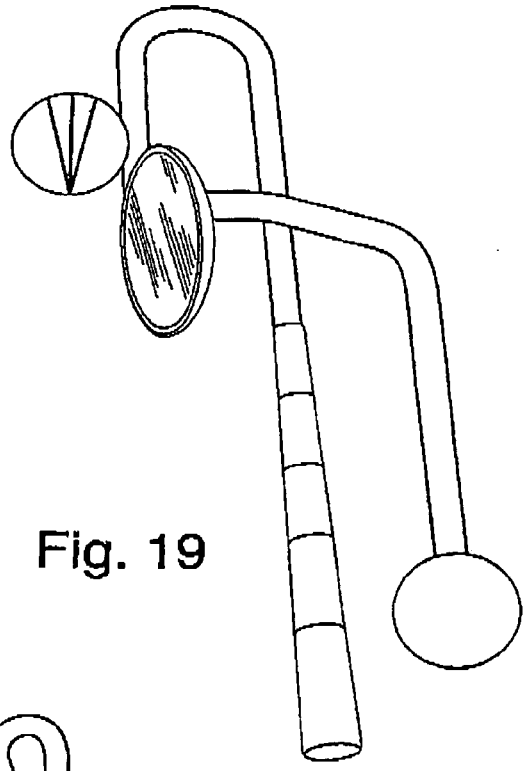
FIG. 19 is a top view of the fourth embodiment of the present invention shown in FIG. 18.
Figure 20:
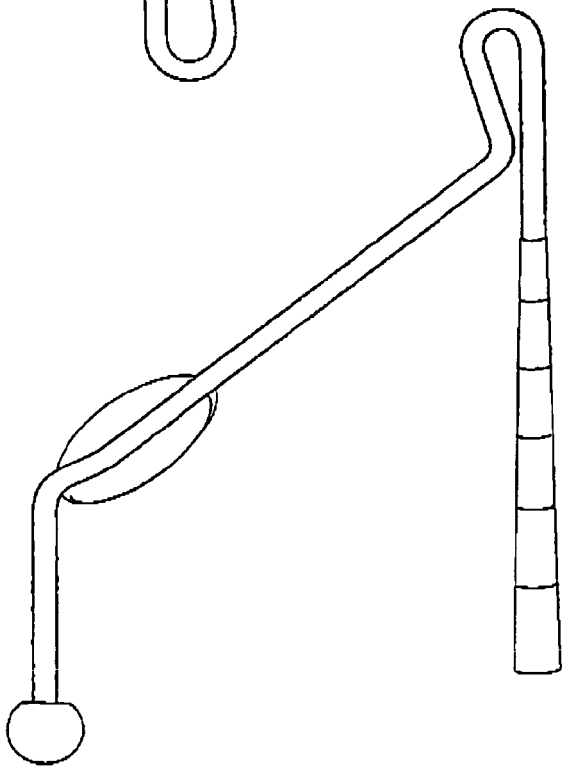
FIG. 20 is a side view of the fourth embodiment of the present invention shown in FIG. 18.

The following disclosure in conjunction with the appended figures discloses preferred embodiments of the present invention. FIGS. 1–6 disclose a first and second embodiment of the present invention, both of which are considered to be stand-alone embodiments. FIGS. 7–8 disclose schematics of the present invention in use and how the various features are used. FIGS. 9–15 disclose step by step how the present invention is used during a typical golf swing. FIGS. 16–17 disclose a third embodiment of the present invention, which is considered to be an attachable or retrofit embodiment. FIGS. 18–20 disclose a fourth embodiment of the present invention, which is considered to be a compact embodiment.

In this specification, the person using the invention is called the user. As disclosed in more detail herein, the user holds the invention in much the same manner as the user would hold an ordinary golf club, and swings the invention in much the same manner as the user would swing an ordinary golf club. All directions, such as outward and sideways, are relative to the standing user. For example, the direction outward would be away from the user, the direction downward would be towards the ground, and the direction sideways would be generally horizontal and tangential to the user. The directions inward and upward would be similarly defined as towards the user and away from the ground, respectively. Horizontal means generally parallel to the earth, and vertical means generally perpendicular to the earth.

Figure 1:
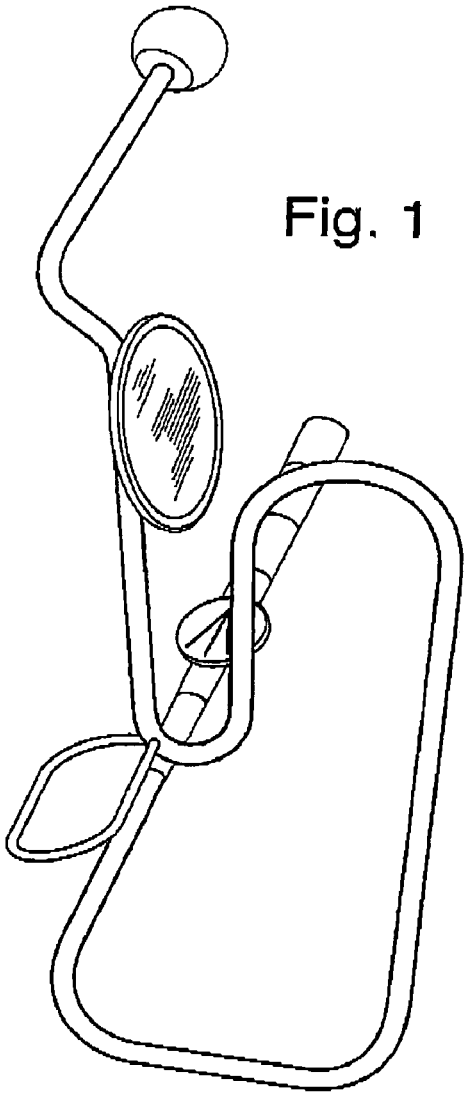
FIG. 1 is a front perspective view of a first embodiment of the present invention.
Figure 2:
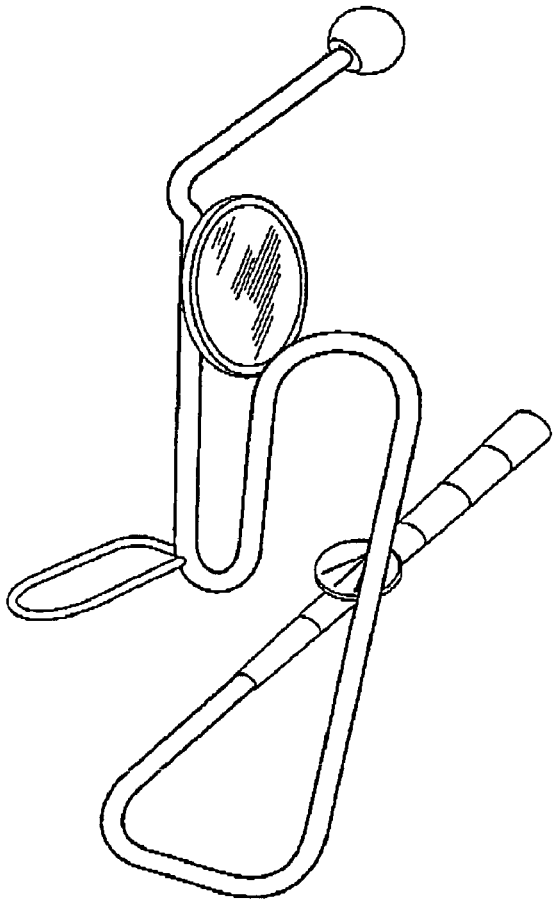
FIG. 2 is a side perspective view of the first embodiment of the present invention shown in FIG. 1.
Figure 3:
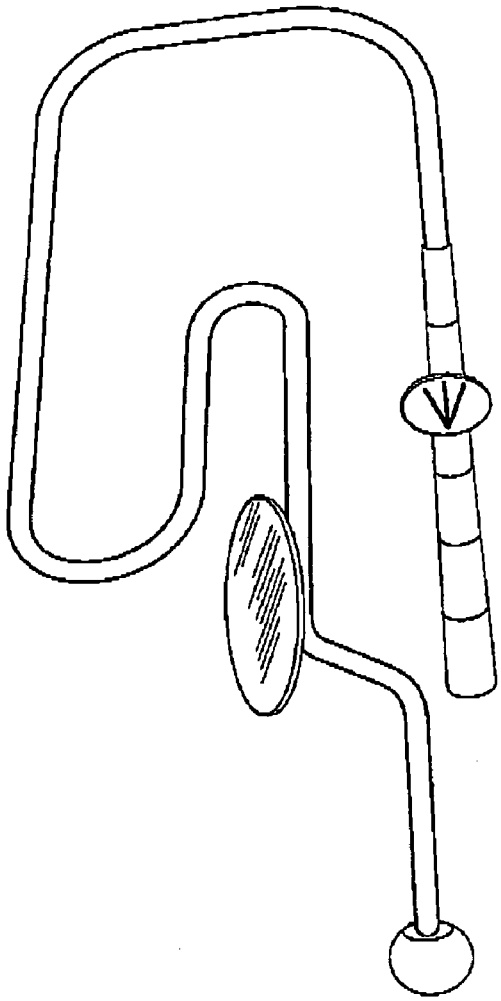
FIG. 3 is a front view of a second embodiment of the present invention.
Figure 4:
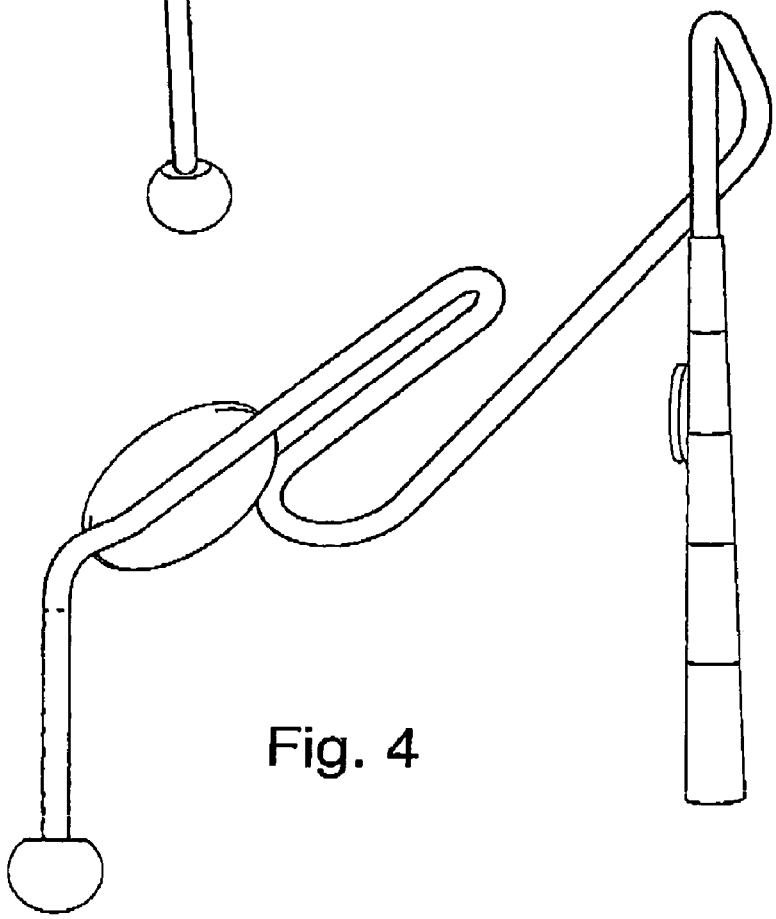
FIG. 4 is a side view of the second embodiment of the present invention shown in FIG. 3.
Figure 5:
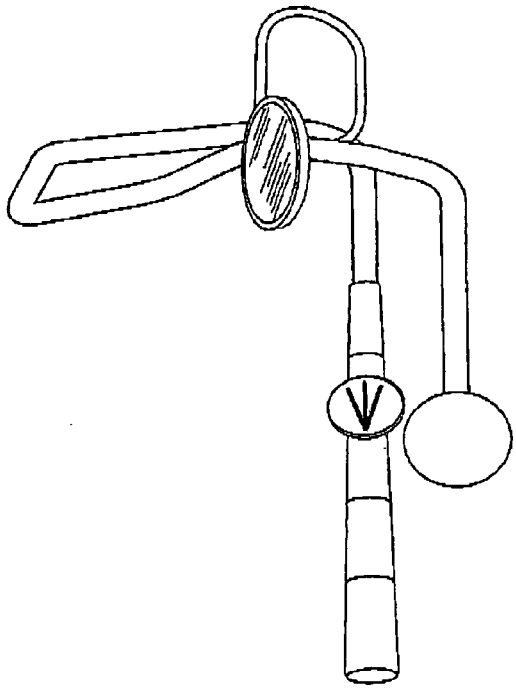
FIG. 5 is a top view of the first embodiment of the present invention shown in FIG. 1.

FIG. 1 is a front perspective view of a first embodiment of the present invention, which is a golf swing training device 10. The description of the device 10 relative to FIG. 1 will be made when the device 10 is held by the user in the ball address position, as illustrated in FIG. 1. FIG. 2 is a side perspective view of the first embodiment of the present invention shown in FIG. 1 and FIG. 5 is a top view of the first embodiment of the present invention shown in FIG. 1. FIGS. 2 and 5 are included to provide additional views of the device 10 from different angles. FIG. 3 is a front view of a second embodiment of the present invention. And FIG. 4 is a side view of the second embodiment of the present invention shown in FIG. 3. FIGS. 3 and 4 are included to provide views of another embodiment of the device 10 and to provide additional views of the device 10 from different angles. FIGS. 6A, 6B and 6C are enlarged views of the vertical indicator in the proper position for simulating various different types of golf clubs.

Referring now to FIGS. 1–6, the basic elements of the device 10 comprise, from one end of the device 10 to the other end of the device 10, grip 12, down shaft 14, cross shaft 16, up shaft 18, sighting and angling section 20, and ball address positioning section 22. The basic elements preferably are securely attached to each other in the order presented previously, and may be formed of a unitary superstructure or tubing, as shown in FIGS. 1–6, or may be separated structures welded, screwed, bolted, pinned or otherwise secured to each other.

Grip 12 can be any conventional or unconventional golf grip. Typically such grips are removable and interchangeable. Thus, the user can substitute different grips on the invention 10 as the user sees fit. Preferably, grip 12 is a teaching grip that will assist the user in maintaining a proper grip on a golf club.

Down shaft 14, cross shaft 16 and up shaft 18 together form a generally offset U-shaped structure, with down shaft 14 and up shaft 18 being the sides of the U and cross shaft 16 being the bottom of the U. Down shaft 14 extends generally coaxially with grip 12 and grip 12, if a separate element from down shaft 14, can be slidably mounted onto a first, or grip, end of down shaft 14. Down shaft 14 preferably is straight and between 6" (15 cm) and 24" (61 cm) long, ending in a sideways first bend or turn 24 of between 80° and 100°, and preferably approximately 90°, relative to an imaginary vertical plane created when the device 10 is held by the user in the ball address position, as illustrated in FIG. 1.

Cross shaft 16 extends generally perpendicular (preferably between 80° to 100°) to down shaft 14 and is connected to down shaft 14 via first bend or turn 24. Cross shaft 16 preferably is straight and between 4" (11 cm) and 15" (38 cm) long, ending in an inward and upward second bend or turn 26 of between 80° and 100°, and preferably approximately 90°, relative to cross shaft 16.

Up shaft 18 extends generally perpendicular (preferably between 80° to 100°) to cross shaft 16 and is connected to cross shaft 16 via second bend or turn 26. Up shaft 18 preferably is straight and between 6" (15 cm) and 24" (61 cm) long, ending in a sideways third bend or turn 28 of between 80° and 100°, and preferably approximately 90°, relative to up shaft 18. Up shaft 18 and down shaft 14 lie in generally or substantially parallel vertical planes, as can be seen best in FIGS. 1 and 3. However, up shaft 18 and down shaft 14 lie in offset axial planes normal to their respective vertical planes, as can be seen best in FIGS. 2 and 4. The angle between these offset axial planes is between 30° and 60°, and preferably between 40° and 50°.

Sighting and angling section 20 extends generally perpendicularly from up shaft 18 and is located between the imaginary vertical planes through down shaft 14 and up shaft 18, and more proximal to the imaginary vertical plane through down shaft 14, as can seen best in FIGS. 3 and 5. As shown in FIGS. 1–5, sighting and angling section 20 can be a relatively tight U bend 30 ending in a sideways fourth bend or turn 38 of between 90° and 130°, and preferably between approximately 100° and 120°, relative to sighting and angling section 20. Alternatively, sighting and angling section 20 can be a planar structure attached to third bend or turn 28. Sighting and angling section comprises sight mirror 32, forearm bar 34, vertical indicator 48, and, optionally, sight window 36, each of which is disclosed in more detail herein. FIGS. 1, 2, and 5 show the placement of optional sight window 36. Sighting and angling section 20 preferably lies in a plane coplanar to or within approximately 10° of the plane containing cross shaft 16 and up shaft 18.

Ball address positioning section 22 extends from sighting and angling section 20 first in a sideways and slightly upwards direction and then in an inwards and slightly upwards direction. More specifically, ball address positioning section 22 comprises displacement bar 40, which extends sideways from sighting and angling section 20 via fourth bend or turn 38, and positioning bar 42, which extends inwardly from displacement bar 40 via fifth bend or turn 44. Safety ball 46 optionally can be used to cover the end of the device 10 to prevent injury to the user.

Sighting mirror 32 is for viewing the golf ball 52 when the user is holding the device 10 in the proper position at the top of the backswing. Sighting mirror 32 is mounted on sighting and aligning section 20 of the superstructure in such a position that when the user has the device 10 at the top of the backswing, thus simulating a golf club at the top of the backswing, the user can view in sighting mirror 32 a golf ball 52 sitting on a tee in the proper position on the ground. When the user can see the golf ball 52 in sighting mirror 32 in this position, the user is holding the device 10 in the proper position, thus simulating holding a golf club in the proper position, at the top of the backswing.

Sighting mirror 32 can be a common reflective mirror and, as can be seen best in FIGS. 1 and 3, is mounted within U bend 30. The angle of sighting mirror 32 should be such that when the user has the device 10 at the top of the backswing, when the user looks in sighting mirror 32, the user will see the golf ball 52 on the tee in front of the user. Sighting mirror 32 also can be adjustable, similar to the adjustable rear view mirrors on an automobile, so that the device 10 can be adjusted for accuracy and/or made suitable for use by more than on golfer or in more than one location. Sighting mirror 32 preferably is placed as close as possible to a position that if one were to draw a straight line from the second knuckle of the user's right forefinger to the target line (an imaginary line through the golf ball pointing in the direction the golfer wishes to hit the golf ball), the center of sighting mirror 32 should line up with this straight line.

Vertical indicator 48 is for indicating to the user that the device 10 is in the proper position at the top of the backswing, as can be seen best in FIG. 6. Vertical indicator 48 is mounted on the sighting and aligning section 20 of the superstructure in such a position that when the user has the device 10 at the top of the backswing, thus simulating a golf club at the top of the backswing, vector 50 on vertical indicator 48 points vertically down to the ground. When vector 50 is pointing vertically down to the ground in this position, the user is holding the device 10 in the proper position, thus simulating holding a golf club in the proper position, at the top of the backswing.

There can be more than one vector 50 on vertical indicator 48 for use with wedges, irons and woods due to the different relative lengths of these three types of clubs. For example, in the three examples shown in FIG. 6A, 6B and 6C, three separate vectors 50A, 50B, 50C are shown on a single vertical indicator 48. FIG. 6A illustrates the positioning of the device 10 at the top of the backswing for a wedge or short iron. The vector 50A on the left points vertically down to the ground when the device 10 is in the proper position at the top of a wedge or short iron backswing. FIG. 6B illustrates the positioning of the device 10 at the top of the backswing for an iron. FIG. 6C illustrates the positioning of the device 10 at the top of the backswing for a wood or long iron.

Vertical indicator 48 can be as simple as a disk attached to the device 10 on or proximal to sighting and aligning section 20, and preferably is mounted within U bend 30. The positioning and angle of vertical indicator 48 should be such that when the user has the device 10 at the top of the backswing, when the user looks at vertical indicator, the user will see vector 50. Vertical indictor 48 also can be adjustable so that the device 10 can be adjusted for accuracy and/or made suitable for use by more than on golfer or in more than one location.

Forearm guide bar 34 is for indicating to the user when the device 10 is in the proper position both at the top of the backswing and at the end of the complete golf swing. Forearm guide bar 34 is located on or is part of sighting and aligning section 20 and, as can be seen best in FIG. 3, preferably is the straight portion of U bend 30 closest to fourth bend or turn 38 and ball address positioning section 22.

Forearm guide bar 34 typically terminates at fourth bend or turn 38. Forearm guide bar 34 is mounted on or a part of sighting and aligning section 20 of the superstructure and is in such a position that when the user has the device 10 at the top of the backswing, thus simulating a golf club at the top of the backswing, forearm guide bas 34 touches the user's right forearm (for right handed golfers). When forearm guide bar 34 touches the user's forearm in this position, the user is holding the device 10 in the proper position, thus simulating holding a golf club in the proper position, at the top of the backswing. Further, when the user has the device 10 at the end of the golf swing (at the end of the follow through), thus simulating a golf club at the end of the golf swing (at the end of the follow through), forearm guide bar 34 touches the user's left forearm (for right handed golfers). When forearm guide bar 34 touches the user's forearm in this position, the user has followed through with the golf swing properly, thus simulating a proper follow golf swing through. For left handed golfers, forearm guide bar 34 touches the user's left forearm at the top of the backswing and the user's right forearm at the end of the follow through.

Sighting window 36 is an optional component for viewing the golf ball 52 when the user is holding the device 10 in the proper position at the golf ball address position. When the user has the device 10 in the golf ball address position, thus simulating a golf club at the golf ball address position, the user can view through sighting window 36 a golf ball 52 sitting on a tee in the proper position on the ground. When the user can see the golf ball 52 in sighting window 36 in this position, the user is holding the invention in the proper position, thus simulating holding a golf club in the proper position, at the ball address position.

Sighting window 36 can be as simple as a wire circle or the like attached to the device 10 on or proximal to sighting and aligning section 20, and preferably is mounted on U bend 30, as can be seen best in FIGS. 2 and 5. The positioning and angle of sighting window 36 should be such that when the user has the device 10 at golf ball address position, when the user looks at sighting window 36, the user will see the golf ball 52. Sighting window 36 also can be adjustable so that the device 10 can be adjusted for accuracy and/or made suitable for use by more than on golfer or in more than one location.

Ball address positioning section 22 is for indicating to the user that the device 10 in the proper position at the golf ball address position. When the user has the device 10 at the ball address position, thus simulating a golf club at the ball address position, the ball address positioning section 22 points directly towards the center of the user's chest, as can be seen best in FIG. 8. When the ball address positioning section 22 points directly towards the center of the user's chest, the user is holding the device 10 in the proper position, thus simulating holding a golf club in the proper position, at the ball address position.

FIG. 7 is a schematic overhead view of a golfer addressing a golf ball 52 and illustrates the use of sighting window 36. As the user addresses the golf ball 52, the user sights the golf ball 52 through sighting window 36. If the user can see the golf ball through sighting window 36, as shown by the dotted line, the device 10 is in the correct position for addressing the golf ball 52. If not, the user can adjust the position of the device to the proper position.

FIG. 8 is a schematic overhead view of a golfer at the top of the backswing and illustrates the use of sighting mirror 32. As the user holds the device 10 at the top of the backswing, the user looks at sighting mirror 22. If the user can see the golf ball 50 in the sighting mirror 32, as shown by the dotted line, the device 10 is in the correct position at the top of the backswing. If not, the user has not correctly carried out the backswing and either can adjust the position of the device 10 or can attempt a new backswing.

Figure 9:
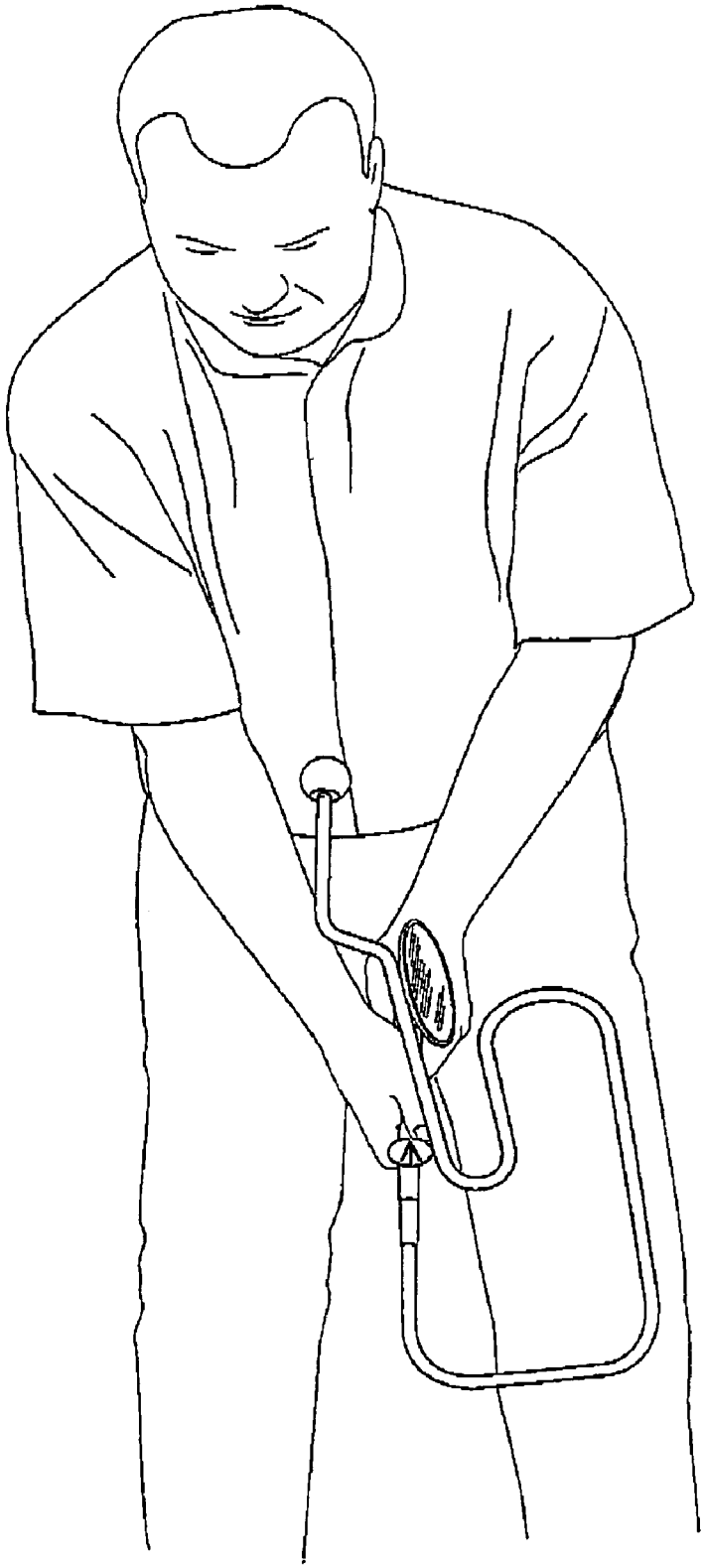
FIG. 9 is front view of a golfer holding the present invention at the beginning of the golf swing.
Figure 10:
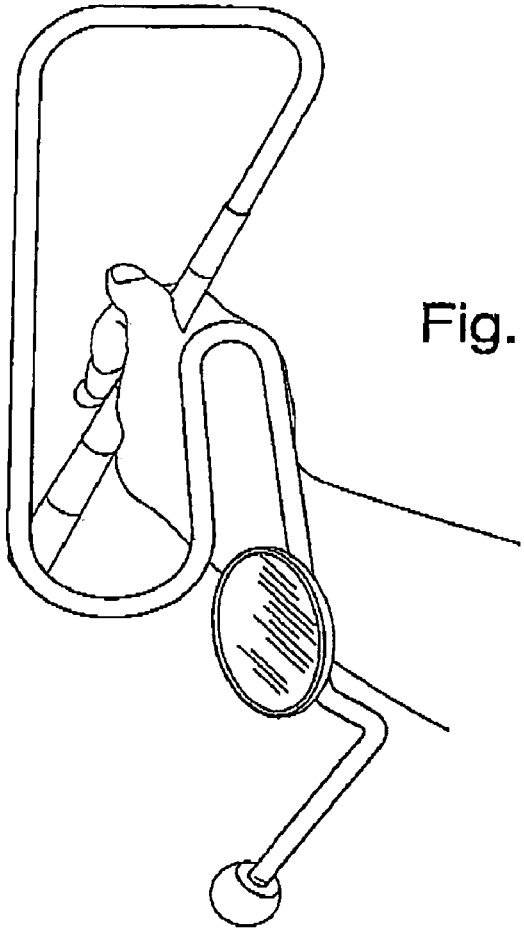
FIG. 10 is a side view of a golfer holding the present invention at the top of the backswing.
Figure 11:
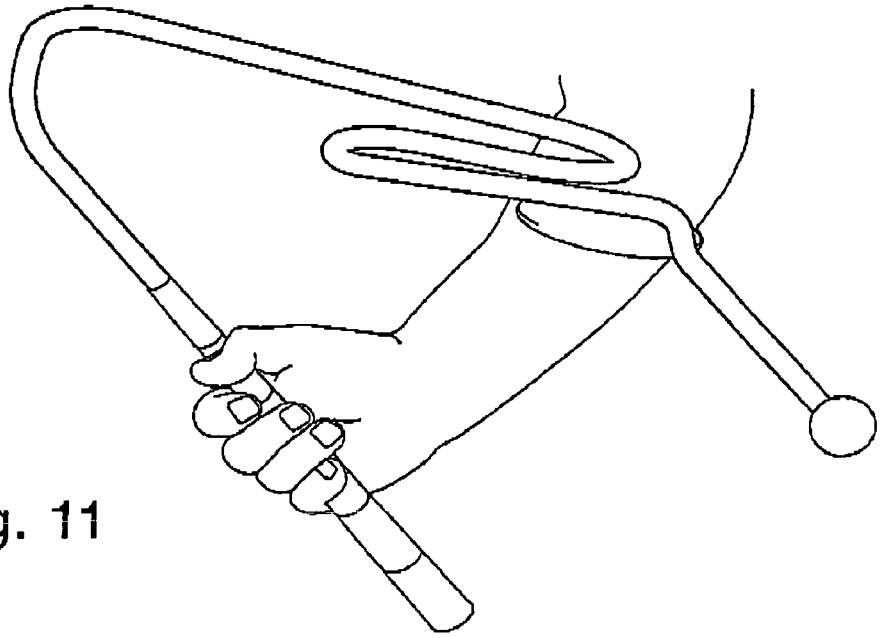
FIG. 11 is a front view of a golfer holding the present invention in the middle of the downswing.
Figure 12:
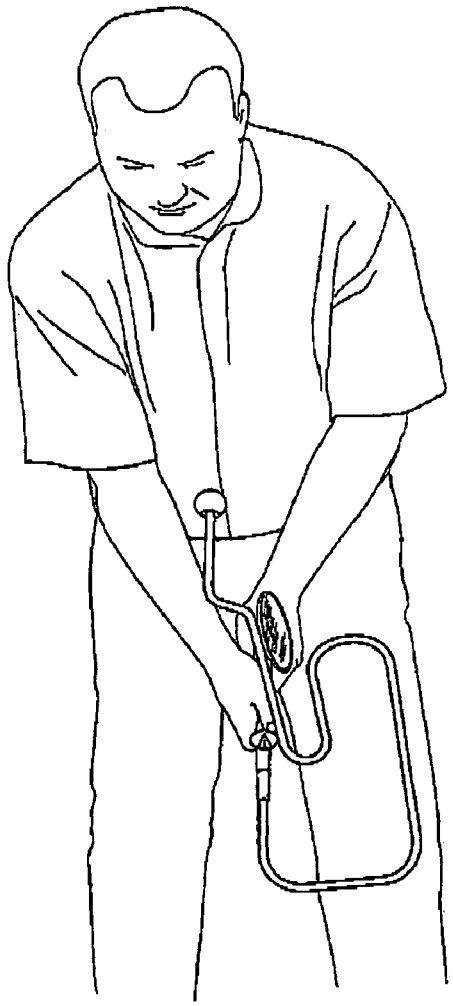
FIG. 12 is a front view of a golfer holding the present invention at the bottom of the swing.
Figure 13:
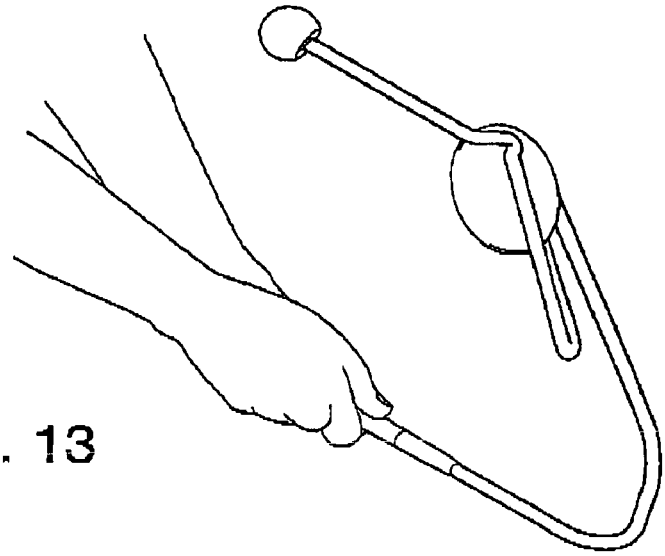
FIG. 13 is a front view of a golfer holding the present invention in the middle of the follow through of the swing.
Figure 14:
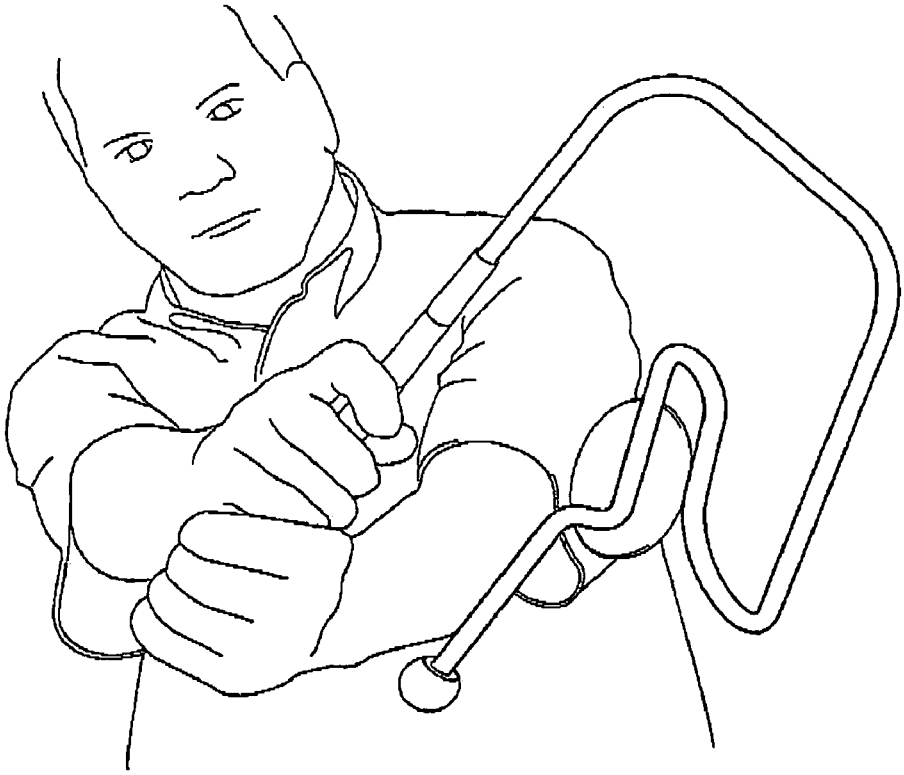
FIG. 14 is a side view of a golfer holding the present invention near the end of the follow through of the swing.
Figure 15:
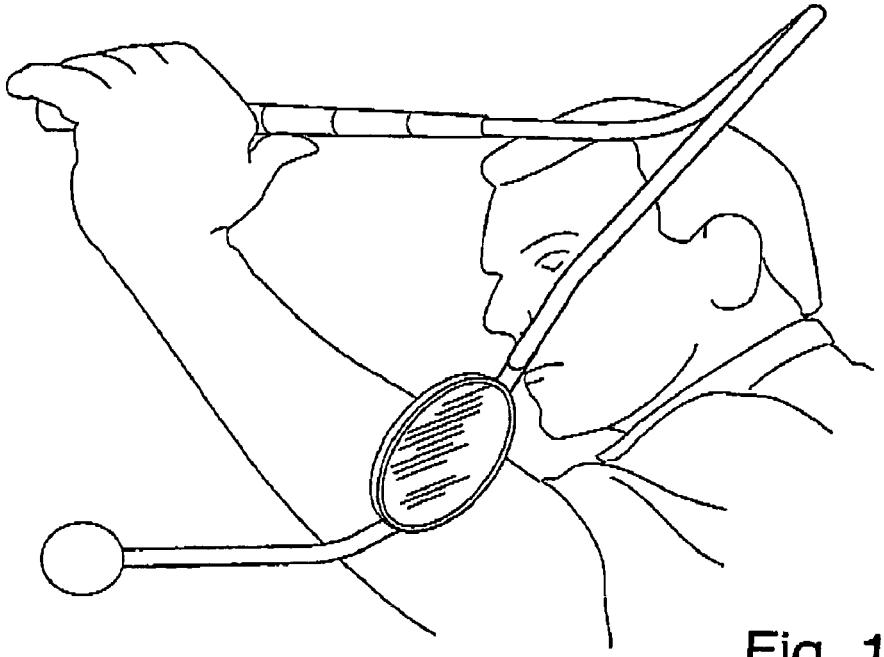
FIG. 15 is a back view of a golfer holding the present invention near the end of the follow through of the swing.

FIGS. 9–15 illustrate a step by step practice swing using the device 10. FIG. 9 is front view of a golfer holding the device 10 at the beginning of the golf swing. FIG. 10 is a side view of a golfer holding the device 10 at the top of the backswing. FIG. 11 is a front view of a golfer holding the device 10 in the middle of the downswing. FIG. 12 is a front view of a golfer holding the device 10 at the bottom of the swing. FIG. 13 is a front view of a golfer holding the device 10 in the middle of the follow through of the swing. FIG. 14 is a side view of a golfer holding the device 10 near the end of the follow through of the swing. FIG. 15 is a back view of a golfer holding the device 10 near the end of the follow through of the swing.

At the beginning of the golf swing as shown in FIG. 9, the user can use the device 10 to determine whether the user is holding the golf club in the proper golf ball address position. The user adjusts the device 10 until the user sees the golf ball 52 through sighting window 36. When the user has the device 10 in the proper golf ball address position, thus simulating a golf club at the proper golf ball address position, the user can view the golf ball 52 through sighting window 36. Further, the user adjusts the device 10 until ball address positioning section 22 points directly towards the center of the user's chest. When ball address positioning section 22 points directly towards the center of the user's chest, the user is holding the device 10 in the proper golf ball address position, thus simulating holding a golf club in the proper position, at the ball address position. Thus, the combination of ball address positioning section 22 and optional sighting window 36 can assist the user in learning to hold the golf club in the proper golf ball address position.

FIG. 10 illustrates a user holding the device 10 at the top of the backswing. The user is a right handed golfer, and the left hand has been removed from the device 10 to give a better view of how the device 10 operates. At the top of the backswing, the user can use sighting mirror 32, forearm guide bar 34, and vertical indicator 48 to determine whether the user has the device 10, and thus a golf club, in the correct position, whether the user has a correct golf stance and whether the user has his or her hands, wrists, elbows and arms in a correct position.

Sighting mirror 32 is for viewing the golf ball 52 when the user is holding the device 10 in the proper position at the top of the backswing as can be seen best in FIG. 10. When the user has the device 10 at the top of the backswing, thus simulating a golf club at the top of the backswing, the user can looks at sighting mirror 32 and adjusts the device 10 until a golf ball 52 sitting on a tee in the proper position on the ground is viewed in sighting mirror 32. When the user can see the golf ball 52 in sighting mirror 32 in this position, the user is holding the device 10 in the proper position, thus simulating holding a golf club in the proper position, at the top of the backswing.

Vertical indicator 48 is for indicating to the user that the device 10 is in the proper position at the top of the backswing as can be seen best in FIG. 10. When the user has the device 10 at the top of the backswing, thus simulating a golf club at the top of the backswing, one vector 50 should be vertical relative to the ground, depending on the golf club being simulated. More specifically, when the user looks at vertical indicator 48, the user will see vector 50, whether a single vector 50 or one of a plurality of separate vectors 50A, 50B, 50C. If simulating a wedge, the user positions the device 10 such that the vector for a wedge is vertical, namely vector 50A in FIG. 6. If simulating an iron, the user positions the device 10 such that the vector for an iron is vertical, namely vector 50B in FIG. 6. If simulating a wood, the user positions the device 10 such that the vector for a wood is vertical, namely vector 50C in FIG. 6. When the appropriate vector 50 on vertical indicator 48 is pointing vertically down to the ground in this position, the user is holding the device 10 in the proper position, thus simulating holding a golf club in the proper position, at the top of the backswing.

Forearm guide 34 is for indicating to the user when the device 10 is in the proper position both at the top of the backswing, as can be seen best in FIG. 10, and at the end of the complete golf swing, as can be seen best in FIGS. 14 and 15. When the user has the device 10 at the top of the backswing, thus simulating a golf club at the top of the backswing, forearm guide 34 touches the inside of the user's right forearm (for right handed golfers). When forearm guide 34 touches the inside of the user's forearm in this position, the user is holding the device 10 in the proper position, thus simulating holding a golf club in the proper position, at the top of the backswing. Further, when the user has the device 10 at the end of the golf swing, thus simulating a golf club at the end of the golf swing, forearm guide 34 touches the outside of the user's left forearm (for right handed golfers). When forearm guide 34 touches the outside of the user's forearm in this position, the user has followed through with the golf swing properly, thus simulating a proper follow golf swing through. For left handed golfers, forearm guide 34 touches the inside of the user's left forearm at the top of the backswing and the outside of the user's right forearm at the end of the follow through.

At the top of the backswing, that is at the completion of the takeaway, if the user can see the golf ball 52 in the sighting mirror 32, the forearm bar 34 is touching the inside of the user's forearm, and vector 50 is vertical relative to the ground, the user has simulated a proper takeaway and is in the proper position for starting the foreswing. By remembering the feel of this position, the golfer is training himself or herself to be in this position when using a real golf club in a real golfing setting.

When swinging a golf club, the club shaft should remain in the same plane, with either end of the club shaft pointing at the target line, which is an imaginary line through the golf ball 52 pointing in the direction the golfer wishes to hit the golf ball 52. The device 10 assists in setting up the proper swing within this plane, and trains the golfer to have a wide swing width, namely, a wide arc created by having the arms outstretched. Positioning forearm guide 34 against the forearm, viewing the golf ball 52 in sight mirror 34, and having vertical indicator 48 in the proper vertical position can achieve this. Further, this positioning means the user's left wrist cock and right wrist bend is in the proper position, and the right forearm and right upper arm create an angle greater than 90°, and preferably between 100° and 120°, relative to each other.

FIGS. 11–13 illustrate the positioning of the device 10 during the actual foreswing of the golf swing. FIG. 11 illustrates a golfer holding the device 10 in the middle of the downswing and shows the positioning of the device 10, and specifically the ball address positioning section 22, between the user's arms. FIG. 12 illustrates a golfer holding the device 10 at the bottom of the swing and also shows the positioning of the device 10, and specifically the ball address positioning section 22, between the user's arms. FIG. 13 illustrates a golfer holding the device 10 in the middle of the follow through of the swing and also shows the positioning of the device 10, and specifically the ball address positioning section 22, between the user's arms.

FIGS. 16 and 17 illustrate a third embodiment of the present invention, namely a device that can be clamped onto an existing golf club 60. FIG. 16 is a front view of this third embodiment and FIG. 17 is a front view of this third embodiment attached to a golf club 60. In this third embodiment, grip 12 and down shaft 14 are eliminated and replaced with a clamp 70. Clamp 70 is attached to and extends axially out of cross shaft 16 on the end of cross shaft 16 opposite second bend or turn 26 and up shaft 18 and is structured to clamp onto an existing golf club 60.

FIGS. 18–20 illustrate a fourth embodiment of the present invention, namely a device 10 having a more compact superstructure. FIG. 18 is a front view, FIG. 19 is a top view and FIG. 20 is a side view of this compact embodiment. In this fourth embodiment, down shaft 14 and up shaft 18 together form a generally offset U-shaped structure, with down shaft 14 and up shaft 18 being the sides of the U. Cross shaft 16 is eliminated. and the U-shape is narrower than in the embodiment shown in FIGS. 1–5.

Down shaft 14 extends generally coaxially with grip 12 and grip 12, if a separate element from down shaft 14, can be slidably mounted onto a first, or grip, end of down shaft 14. Down shaft 14 preferably is straight and between 6" (15 cm) and 24" (61 cm) long, ending in a sideways first bend or turn 24 of between 170° and 190°, and preferably approximately 180°, relative to an imaginary vertical plane created when the device 10 is held by the user in the ball address position, as illustrated in FIG. 18.

Up shaft 18 and down shaft 14 lie in generally or substantially parallel vertical planes, as can be seen best in FIGS. 18 and 19. However, up shaft 18 and down shaft 14 lie in offset axial planes normal to their respective vertical planes, as can be seen best in FIG. 20. The angle between these offset axial planes is between 30° and 60°, and preferably between 40° and 50°. The distance between the offset axial planes is preferably between 1" (2.5 cm) and 4" (11 cm).

Sighting and angling section 20 in this fourth embodiment is a part of up shaft 18, as can seen best in FIG. 18. Sighting and angling section comprises sight mirror 32 and vertical indicator 48 attached to the side of up shaft 18 opposite down shaft 14. Forearm guide bar 34 in this fourth embodiment is a portion of up shaft 18. Optional sight window 36 in this embodiment is an upturn of first bend or turn.

Ball address positioning section 22 extends from sighting and angling section 20 first in a sideways and slightly upwards direction and then in an inward and slightly upwards direction in much the same manner as disclosed in connection with the first and second embodiments.

Although this specification has described the use of the device 10 in connection with a golf ball 52 sitting on a tee in front of the user, a golf ball 52 is not necessary. The user can imagine a golf ball 52 at an appropriate position, or can use any object or the like as a representation of a golf ball 52. Further, a right handed golfer and a device 10 structured for a right handed golfer have been used to describe the preferred embodiments. The device 10 can be structured for a left handed golfer by using a mirror image of the device 10 as shown in the FIGS.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

What is claimed is:

1. A golf swing training device comprising a substantially U-shaped shaft having a golf grip at a first end and a forearm-touching member proximal to an opposite second end, wherein the U-shaped shaft comprises a down shaft, a cross shaft and an up shaft, wherein the U-shaped structure has offset arms, with the down shaft and the up shaft being the sides of the U-shaped structure and the cross shaft being the bottom of the U-shaped structure; and wherein the down shaft.

2. The golf swing training device as claimed in claim 1, wherein said forearm-touching member has an elongated rod-like shape.

3. The golf swing training device as claimed in claim 2, further comprising a sighting section located between the first end and the second end, wherein the sighting section comprises a mirror for viewing a golf ball when the golf swing training device is held in a proper backswing position.

4. The golf swing training device as claimed in claim 3, wherein the sighting section further comprises a vertical indicator for indicating when the golf swing training device is a proper backswing position.

5. The golf swing training device as claimed in claim 4, wherein the vertical indicator is structured for indicating that the golf swing training device is in a proper position at the top of a proper backswing position.

6. The golf swing training device as claimed in claim 5, wherein the vertical indicator is mounted on the sighting section in such a position that when the user has the golf swing training device at the top of the proper backswing position, a vector on the vertical indicator points vertically down to the ground.

7. The golf swing training device as claimed in claim 2, wherein the U-shaped shaft comprises a down shaft and an up shaft, wherein the U-shaped structure has offset arms, with the down shaft and the up shaft being the sides of the U-shaped structure and being connected to each other by a first bend.

8. The golf swing training device as claimed in claim 7, wherein said forearm-touching member has an elongated rod-like shape.

9. The golf swing training device as claimed in claim 8, further comprising a sighting section located between the first end and the second end, wherein the sighting section comprises a mirror for viewing a golf ball when the golf swing training device is held in a proper backswing position.

10. The golf swing training device as claimed in claim 9, wherein the sighting section further comprises a vertical indicator for indicating when the golf swing training device is a proper backswing position.

11. The golf swing training device as claimed in claim 10, wherein the vertical indicator is structured for indicating that the golf swing training device is in a proper position at the top of a proper backswing position.

12. The golf swing training device as claimed in claim 11, wherein the vertical indicator is mounted on the sighting section in such a position that when the user has the golf swing training device at the top of the proper backswing position, a vector on the vertical indicator points vertically down to the ground.

13. The golf swing training device as claimed in claim 12, wherein the U-shaped shaft comprises a down shaft, a cross shaft and an up shaft, wherein the U-shaped structure has offset arms, with the down shaft and the up shaft being the sides of the U-shaped structure and the cross shaft being the bottom of the U-shaped structure.

14. The golf swing training device as claimed in claim 13, wherein the down shaft is straight and between 6" (15 cm) and 24" (61 cm) long, ending in a sideways first bend of between 80° and 100° relative to an imaginary vertical plane created when the golf swing training device is held in a proper ball address position.

15. The golf swing training device as claimed in claim 13, wherein the cross shaft extends between 80° and 100° from the down shaft and is connected to the down shaft via the first bend.

16. The golf swing training device as claimed in claim 15, wherein the cross shaft is straight and between 4" (11 cm) and 15" (38 cm) long, ending in an inward and upward second bend of between 80° and 100° relative to the cross shaft.

17. The golf swing training device as claimed in claim 13, wherein the up shaft extends between 80° and 100° from the cross shaft and is connected to the cross shaft via the second bend or turn.

18. The golf swing training device as claimed in claim 17, wherein the up shaft is straight and between 6" (15 cm) and 24" (61 cm) long, ending in a sideways third bend of between 80° and 100° relative to the up shaft.

19. The golf swing training device as claimed in claim 18, wherein the up shaft and the down shaft lie in substantially parallel vertical planes and in offset axial planes normal to their respective vertical planes, with the angle between the offset axial planes being between 30° and 60°.

20. The golf swing training device as claimed in claim 17, further comprising a sighting section located between the first end and the second end, wherein the forearm-touching member is located proximal to the sighting section.

21. The golf swing training device as claimed in claim 20, wherein the forearm-touching member is structured to touch a users forearm for indicating to the user when the golf swing training device is in a proper position at the top of a proper backswing position.

22. The golf swing training device as claimed in claim 8, wherein the down shaft is straight and between 6" (15 cm) and 24" (61 cm) long and the up shaft is straight and between 6" (15 cm) and 24" (61 cm) long.

23. The golf swing training device as claimed in claim 22, wherein the up shaft and the down shaft lie in substantially parallel vertical planes and in offset axial planes normal to their respective vertical planes, with the angle between the offset axial planes being between 30° and 60°.

24. The golf swing training device as claimed in claim 23, further comprising a sighting section located between the first end and the second end, wherein the forearm-touching member is located proximal to the sighting section.

25. The golf swing training device as claimed in claim 8, wherein the forearm-touching member is structured to touch a user's forearm for indicating to the user when the golf swing training device is in a proper position at the top of a proper backswing position.

26. The golf swing training device as claimed in claim 2, further comprising a sighting section located between the first end and the second end, wherein the sighting section comprises a vertical indicator for indicating when the golf swing training device is a proper backswing position.

27. The golf swing training device as claimed in claim 26, wherein the vertical indicator is structured for indicating that the golf swing training device is in a proper position at the top of a proper backswing position.

28. The golf swing training device as claimed in claim 27, wherein the vertical indicator is mounted on the sighting section in such a position that when the user has the golf swing training device at the top of the proper backswing position, a vector on the vertical indicator points vertically down to the ground.

29. The golf swing training device as claimed in claim 26, wherein the U-shaped shaft comprises a down shaft and an up shaft, wherein the U-shaped structure has offset arms, with the down shaft and the up shaft being the sides of the U-shaped structure and being connected to each other by a first bend.

30. The golf swing training device as claimed in claim 29, wherein the down shaft is straight and between 6" (15 cm) and 24" (61 cm) long and the up shaft is straight and between 6" (15 cm) and 24" (61 cm) long.

31. The golf swing training device as claimed in claim 29, wherein the up shaft and the down shaft lie in substantially parallel vertical planes and in offset axial planes normal to their respective vertical planes, with the angle between the offset axial planes being between 30° and 60°.

32. The golf swing training device as claimed in claim 29, wherein the forearm-touching member is structured to touch a user's forearm for indicating to the user when the golf swing training device is in a proper position at the top of a proper backswing position.

33. The golf swing training device as claimed in claim 32, wherein the vertical indicator is structured for indicating that the golf swing training device is in a proper position at the top of a proper backswing position.

34. The golf swing training device as claimed in claim 33, wherein the vertical indicator is mounted on the sighting section in such a position that when the user has the golf swing training device at the top of the proper backswing position, a vector on the vertical indicator points vertically down to the ground.

35. The golf swing training device as claimed in claim 29, wherein said forearm-touching member has an elongated rod-like shape.

36. The golf swing training device as claimed in claim 35, wherein the sighting section further comprises a sighting window for viewing a golf ball when the golf swing training device is held in a proper ball address position.

37. The golf swing training device as claimed in claim 1, wherein the down shaft is straight and between 6" (15 cm ) and 24" (61 cm ) long, ending in a sideways first bend of between 80° and 100° relative to an imaginary vertical plane created when the golf swing training device is held in a proper ball address position.

38. The golf swing training device as claimed in claim 1, wherein the cross shaft extends between 80° and 100° from the down shaft and is connected to the down shaft via the first bend.

39. The golf swing training device as claimed in claim 38, wherein the cross shaft is straight and between 4" (11 cm) and 15" (38 cm) long, ending in an inward and upward second bend of between 80° and 100° relative to the cross shaft.

40. The golf swing training device as claimed in claim 1, wherein the up shaft extends between 80° and 100° from the cross shaft and is connected to the cross shaft via the second bend or turn.

41. The golf swing training device as claimed in claim 40, wherein the up shaft is straight and between 6" (15 cm ) and 24" (61 cm) long, ending in a sideways third bend of between 80° and 100° relative to the up shaft.

42. The golf swing training device as claimed in claim 41, wherein the up shaft and the down shaft lie in substantially parallel vertical planes and in offset axial planes normal to their respective vertical planes, with the angle between the offset axial planes being between 30° and 60°.

43. The golf swing training device as claimed in claim 40, further comprising a sighting section located between the first end and the second end, wherein the forearm-touching member is located proximal to the sighting section.

44. The golf swing training device as claimed in claim 43, wherein the forearm-touching member is structured to touch a user's forearm for indicating to the user when the golf swing training device is in a proper position at the top of a proper backswing position.

* * * * *